US006116165A

United States Patent [19]

Kadesky

[11] Patent Number: 6,116,165

[45] Date of Patent: Sep. 12, 2000

[54] LAP TRAY

[76] Inventor: Yale M. Kadesky, 1604 Quail Ridge Rd., Escondido, Calif. 92027

[21] Appl. No.: 09/017,933

[22] Filed: Feb. 3, 1998

[51] Int. Cl.[7] ..... A47B 23/00

[52] U.S. Cl. ..... 108/43; 108/161

[58] Field of Search ..... 108/43, 161, 25, 108/26, 42, 49

[56] References Cited

U.S. PATENT DOCUMENTS

| | | | |
|---|---|---|---|
| 1,851,600 | 3/1932 | Stanley | 108/43 |
| 4,947,526 | 8/1990 | Fogelman | 108/161 X |
| 5,009,379 | 4/1991 | Sadler | 108/49 X |
| 5,355,811 | 10/1994 | Brewer | 108/43 |
| 5,359,741 | 11/1994 | Lang | 108/49 X |
| 5,607,091 | 3/1997 | Musacchia | 108/43 X |
| 5,642,541 | 7/1997 | Corbin | 108/49 X |

*Primary Examiner*—Jose V. Chen

*Attorney, Agent, or Firm*—Frank D. Gilliam

[57] ABSTRACT

A tray for use on the lap of a person for supporting a small bet or use in activities such as card games, writing, etc. The lap tray is formed from an elongated, flexible plastic panel formed from a plastic such as high density polyethylene. The lap tray has a flat central portion with two intermediate portions extending from ends of the central portion at approximately 90° to the central portions and two end portions extending from ends of the intermediate portions toward each other, approximately parallel to the central portion. The end portions can be manually spread apart and the tray placed over the thighs with the central portion across the thighs and the other portions around the legs. For storage, the end portions may be folded against the intermediate portions and the resulting assemblies folded against the central portion to form a relatively thin, flat package. If desired, suitable restraints, such as elastic bands, may be used to hold the package in the stored position. For use, the restraints are simply removed and the tray automatically returns to the use position. A tight fitting liquid absorbing fabric cover is preferably provided over tray.

16 Claims, 1 Drawing Sheet

LAP TRAY

FIELD OF THE INVENTION

This invention relates to a lap tray for use in supporting items on a person's lap in a chair, automobile or the like and which can be folded to a compact package when not in use.

BACKGROUND OF THE INVENTION

A person seated in an automobile seat, a chair, a stadium seat, etc. often needs to hold objects on his or her lap. These might include food, drink containers, business papers, games, small pets, etc. Such things are difficult to support directly on the lap. A number of different trays, panels, clipboards and the like have been developed to meet this need, with varying degrees of effectiveness.

A fast food lap tray assembly is described by Eisenberg in U.S. Pat. No. 5,520,119. This assembly includes a thick, molded tray for placement across a user's thighs, having a plurality of recesses molded into the tray top for receiving correspondingly shaped fast food containers, drink cups, etc. Downwardly extending pliable straps are provided at the sides of the tray for wrapping under the user's legs. While effective with fast food containers sized to fit the recesses, this tray does not have a surface useful for holding pets, paperwork, games and other activities requiring a generally flat surface. The pliable straps would be difficult to tightly wrap around the thighs and would be likely to come loose during use, allowing the tray to move about, particularly in a moving vehicle. With the recesses and straps, this tray is quite thick and could not be stored in a small or narrow space, such as the space generally available below automobile seats. A cloth cover cannot be fitted snugly over such a tray. Also, a tray having so many recess corners would be difficult to clean.

A clipboard with a strap for fastening to a user's thigh is described by Senior et al. In U.S. Pat. No. 2,701,173. This clipboard would be useful in doing paperwork, but is not adaptable to extending across the entire lap. The strap could be difficult to fasten and the assembly could easily rotate to the side so that the surface would not be level.

A foldable lap tray is described by Hood in U.S. Pat. No. 5,127,339. A corrugated cardboard sheet is folded about a user's thighs and connected under the thighs. Wrapping this assembly about the thighs and closing the connection would be quite difficult, and the stiff cardboard would not be comfortable.

A number of different lap trays have been designed that essentially consist of a flat or shaped panel that rests on the thighs with no means for holding the panel in place. Typical of these are the devices described by Harris et al. In U.S. Pat. No. Design 308,450 and U.S. Pat. No. 5,680,973. These trays nave nothing to hold them in place on the lap and would generally be quite large and difficult to store in a small space.

Thus, there is a continuing need for a lap tray for use with any seat to protect the lap from spills and the like, to support weight above the lap, having a basically flat surface for supporting a small animal, writing, eating and playing games, that can be easily cleaned, that can be easily secured to, and released from, the legs and which is thin and compact for easy storage when not in use.

SUMMARY OF THE INVENTION

The above-noted problems, and others are overcome in accordance with this invention by a lap tray formed from a continuous elongated flexible plastic panel and enclosed in a close fitting, removable, fabric cover. The tray includes a generally flat central portion having two intermediate portions bent at about 90° to the central portion and two end portions having return bends to a position approximately parallel to the central portion.

The end portions are configured to be foldable against the intermediate portions forming a generally flat assembly. These assemblies are in turn foldable against the central portion to produce a thin package for storage, shipment or the like. The package can be retained in the folded position by inserting the package into a narrow space, such as under an automobile seat or may be held folded by any suitable clips, elastic bands, etc. The plastic material is selected to have sufficient elasticity when set in the unfolded position to return to that position when in the folded position and released. Any suitable plastic having the characteristics of retaining a set shape while permitting folding and of returning to the set shape when released may be used. Preferred materials include polyolifins such as polyethylene and polypropylene. An optimum combination of characteristics is found with high density polyethylene, which is therefor the optimum material for the tray of this invention.

While any suitable cover material may be used, the cover is preferably formed from a fabric material that readily absorbs liquids spilled thereon and is easily washable. Optimum materials for this purpose include knit materials and various cotton or cotton/polyester blends. The cover is preferably has two flat panels sewn together along three edges and having a fastener such as a zipper on Velcro® hook and loop material along the fourth edge. The cover is preferably sized so that the tray is a substantially tight fit therein. The cover may have various associated accessories, such as pockets in the cover along the outside surface of the intermediate portion for holding pencils, paper pads, cards, other games, etc. A fabric cover is more comfortable, will absorb spilled liquids and is more comfortable for small pets and provides a textured surface to prevent slippage.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
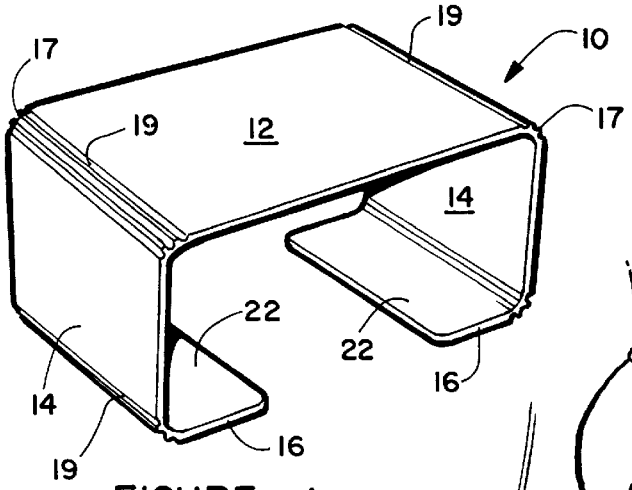
FIG. 1 is a perspective view of the lap tray of this invention.
Figure 2:
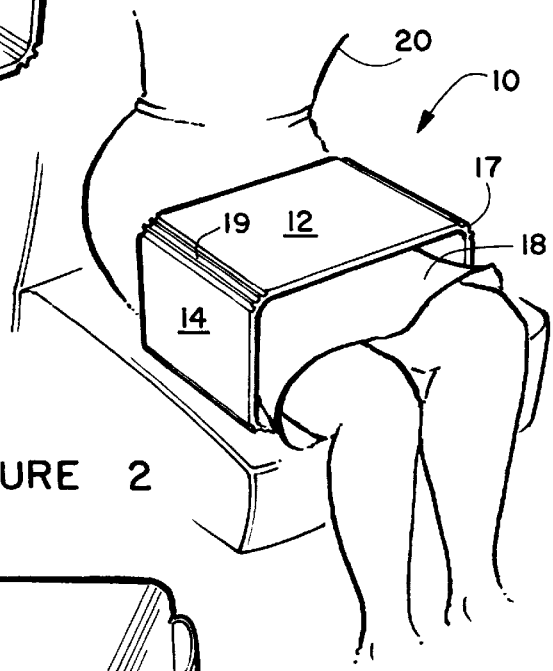
FIG. 2 is a perspective view of the lap tray shown in FIG. 1 in use by a person.

Referring to FIGS. 1 and 2, there is seen a lap tray 10 formed from an elongated panel of a flexible plastic material. The plastic selected should be shape retaining but capable of being bent or folded and return to the original configuration when released. Any suitable plastic having these characteristics may be used. Polyolifins generally have an optimum combination of these characteristics. Of the polyolefins, polypropylene and high density polyethylene are preferred, with high density polyethylene providing optimum results.

Lap tray 10 has a generally flat central portion 12, bounded by two intermediate portions 14 having bends 17 to lie at approximately 90° to the plane of central portion 12. End portions 16 have return bends 17 so that the ends extend towards each other generally parallel to central portion 12. Preferably, bends 17 provide smooth curves, typically having radii of at least about 1 inch. Preferably, intermediate portions 14 and end portions 16 are approximately flat away from bends 17.

As seen in FIG. 2, lap tray 10 fits over the thighs 18 of a person 20 using the lap tray while seated in a chair, automobile seat, etc. To place lap tray 10 over thighs 18, the user simply grasps edges 22 of end portions 16 and pulls them apart sufficiently to lower the edges over the thighs, then releases the tray, which then automatically returns to the configuration seen in FIG. 1. To remove lap tray 10, the user grasps the lowermost end of intermediate portions 14 and pulls them apart while lifting the tray. The selected plastic material can be severely deformed, even to the point of almost flattening the panel without permanent deformation. Further, the plastic material is sufficiently flexible that end portions 16 easily conform to the shape of the underside of the user's thighs 18 for complete comfort during use.

The lap tray may have any suitable dimensions. For adults, generally central portion 12 would preferably have a width (parallel to the user's legs) of from about 10 to 14 inches and a length (perpendicular to the user's legs) of from about 15 to 18 inches. The vertical intermediate portions 14 preferably have heights of from 5 to 7 inches, with end portions 16 extending from about 4 to 7 inches, with the height of the intermediate portions being equal to or grater than the extension of the end portions for convenience in folding lap tray 10, as detailed below.

Intermediate portions 14 preferably lightly contact the sides of the user's thighs. Further, intermediate portions 14 preferably have heights such that central portion 12 males ;ogjt cpmtact with thighs 18 so that lap tray 10 supports the weight of objects on the tray.

For best results, the width of central portion 12, intermediate portions 14 and end portions 16 are at least approximately the same.

For optimum utility in comfortably fitting persons with different sized thighs, at least two spaced transverse scores 19 are formed at each corner 17 as illustrated in FIG. 1. These scores provide different bending locations so that the width of the central portion 12 and the heigh of the intermediate portions 14 can bve varied for maximum comfort and utility. Optimally, three scores 19 are provided at each corner 17. These scores 19 help the panel bend around a selected straight transverse line. A person with average thighs would bend corners 17 at a central score 19 at each corner. A person with thicker, wider, thighs would bend the corner 17 between central portion. 12 and intermediate portion 14 at the score 19 nearest the portion 14 to provide the widest top and would bend along the score between the intermediate portion 14 and end portions 16 which is closest to the end edge 22, to provide the greatest elevation. A smaller person would bend the panels along scores providing a smaller central portion and shorter intermediate portions. Ideally, the tray is snug against the thighs, neither loose which would adversely affect stability nor so tight as to be uncomfortable. With several score lines, a user would quickly learn which scores should be used to provide the most comfortable and stable tray arrangement.

For children of ages 8–10, the preferred dimensions are central portion width of about 8–10 inches, central portion length about 9–12, intermediate portion height about 3–5 inches and end portion extension about 3–5 inches. Of course, other sizes may be made for use by smaller or larger persons.

Figure 3:
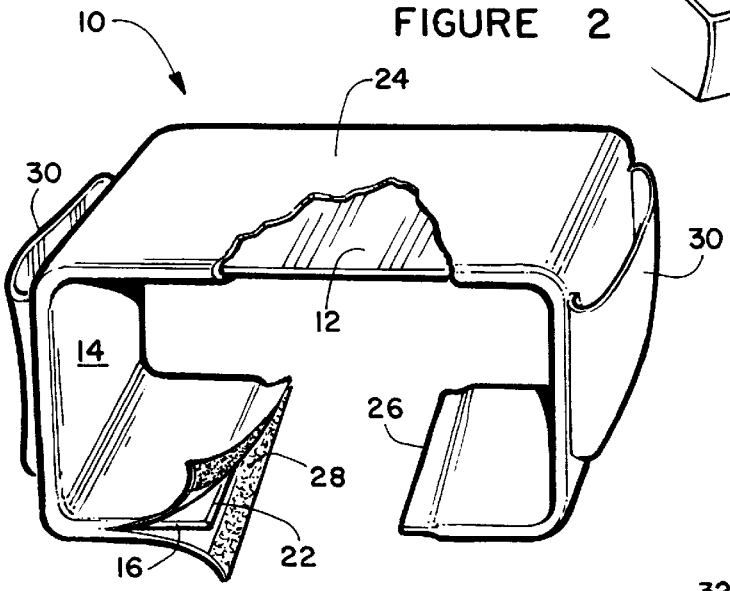
FIG. 3 is a perspective view of a second embodiment of the lap tray with a close fitting cover thereover.

As seen in FIG. 3, a cover 24 is preferably included for enclosing lap tray 10. FIG. 3 also illustrates an embodiment wherein intermediate portions are curved rather than flat. While cover 24 may be formed from any suitable material, a liquid absorbing, washable, fabric material is preferred. Preferably, cover 24 fits tightly over lap tray 10 to avoid significant wrinkles that could interfere with writing on the tray, playing games, etc. Cover 24 is generally pocket-shaped has an opening 26 along one end for insertion of lap tray 10 thereinto. Preferably, opening 26 is along one edge 22 of an end portion 16. Any suitable closure 28 may be used to tightly hold cover 24 over lap tray 10. Typically, a zipper or Velcro® hook and loop material may be used to releasably close opening 26.

If desired, various pockets 30 may be secured to cover 24 at appropriate locations, preferably along intermediate portions 14. Such pockets are out of the way and are convenient for holding pencils, crayons, notebooks, playing cards, etc. Pockets 30 typically have openings along upper edges, which may be closed with snaps, zippers or Velcro® hook and loop material as desired.

Figure 4:
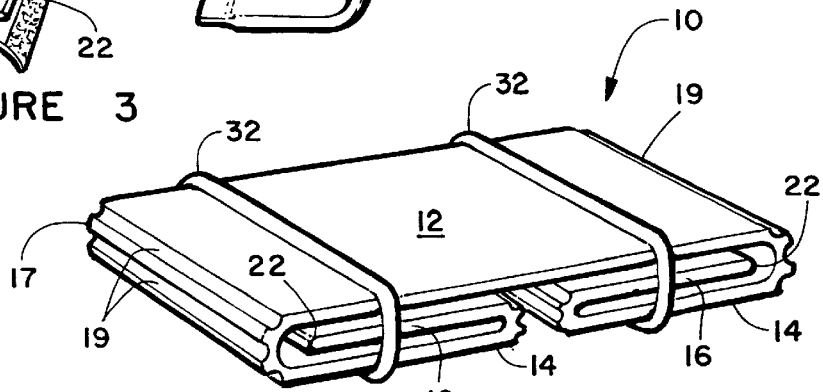
FIG. 4 is a perspective view of a folded lap tray with a band for maintaining that configuration.

FIG. 4 illustrates folding of lap tray 10 for storage. To fold lap tray 10, a user folds end portions 16 against the inner side of intermediate portions 14, then folds that assembly against the underside of central portion 12.

Where lap tray 10 is being used in an automobile, the folded lap tray could simply be inserted under a seat. Alternately, lap tray 10 can be releasably secured in the folded position in any suitable manner, such as by wrapping elastic bands 32 around the folded tray (as seen in FIG. 4) in either direction, inserting the folded tray into a box, placing clips over the folded edges, etc. To use lap tray 10, one simply removes the tray from a container or removes the restraining means and the tray will return to the use position through elastic memory. If desired the end portions 16 and intermediate portions 14 could be flattened and both could be folded flat against the second surface of central panel 12.

While certain specific relationships, materials and other parameters have been detailed in the above description of preferred embodiments, those can ve varied, where suitable, with similar results. Other applications, variation and ramifications of the present invention will occur to those skilled in the art upon reading the present disclosure. Those are intended to be included within the scope of this invention as defined in the appended claims.

I claim:

1. A lap tray which comprises:

a continuous elongated panel of flexible, shape retaining plastic material;

said panel when in a use configuration comprises a substantially planar central portion, two intermediate portions bent about bend lines substantially transverse to said elongated panel toward said second surface approximately 90° to said planar central portion and two end portions bent about bend lines substantially transverse to said elongated panel toward said second surface of said central portion to lie approximately parallel to and spaced from said planar central portions;

said end and intermediate portions being foldable against said intermediate portions to form an assembly with second surfaces of said end and intermediate portions approximately parallel and closely spaced;

said assembly being foldable against said central portion with first surfaces of said end portions approximately parallel and closely spaced to the second surface of said central portion; and said plastic material having elastic memory means for returning said panel to said use configuration when released.

2. The lap tray according to claim 1 further including a removable bag-like cover having an open end and configured to slip over said panel and closely conform to said panel.

3. The lap tray according to claim 2 wherein said cover is formed from liquid-absorbent fabric material and further includes means for closing said open end.

4. The lap tray according to claim 2 wherein said cover includes at least one pocket having a releasable closure means.

5. The lap tray according to claim 1 wherein further including means for restraining said lap tray in a fully folded position.

6. The lap tray according to claim 1 wherein said lap tray is configured for use by an adult and said lap tray panel is approximately rectangular, said central portion has a width of from about 10 to 14 inches and a length of from about 15 to 18 inches, said intermediate portions each has a height of from about 5 to 7 inches and said end portions extend from said intermediate portions about 4 to 7 inches.

7. The lap tray according to claim 1 wherein said lap tray is configured for use by a child of about 8–10 years age and lap tray panel is approximately rectangular, said central portion has a width of from about 8 to 10 inches and a length of from about 9 to 12 inches, said intermediate portions each has a height of from about 3 to 5 inches and said end portions extend from said intermediate portions about 3 to 5 inches.

8. The lap tray according to claim 1 wherein said panel is formed from a polyolefin.

9. The lap tray according to claim 1 wherein said panel is formed from high density polyethylene.

10. The lap tray according to claim 1 further including at least two spaced scores in a surface of said elongated panel along said bend lines.

11. A lap tray which comprises:

a continuous elongated panel of flexible, shape retaining, high density polyethylene;

said panel when in a use configuration comprises a substantially planar central portion, two intermediate portions bent about bend lines substantially transverse to said elongated panel toward said second surface approximately 90° to said planar central portion and two end portions bent about bend lines substantially transverse to said elongated panel toward said second surface of said central portion to lie approximately parallel to and spaced from said planar central portions;

said end and intermediate portions being foldable against said intermediate portions to form an assembly with second surfaces of said end and intermediate portions approximately parallel and closely spaced;

said assembly being foldable against said central portion with first surfaces of said end portions approximately parallel and closely spaced to the second surface of said central portion; and said plastic material having elastic memory means for returning said panel to said use configuration when released.

12. The lap tray according to claim 11 wherein said cover includes releasable closure means for closing said opening and at least one pocket having a releasable closure means.

13. The lap tray according to claim 11 wherein further including means for restraining said lap tray in a fully folded position.

14. The lap tray according to claim 11 wherein said lap tray is configured for use by an adult and said lap tray panel is approximately rectangular, said central portion has a width of from about 10 to 14 inches and a length of from about 15 to 18 inches, said intermediate portions each has a height of from about 5 to 7 inches and said end portions extend from said intermediate portions about 4 to 7 inches.

15. The lap tray according to claim 11 wherein said lap tray is configured for use by a child of about 8–10 years age and lap tray panel is approximately rectangular, said central portion has a width of from about 8 to 10 inches and a length of from about 9 to 12 inches, said intermediate portions each has a height of from about 3 to 5 inches and said end portions extend from said intermediate portions about 3 to 5 inches.

16. The lap tray according to claim 11 further including at least two spaced scores in a surface of said elongated panel along said bend lines.

* * * * *